United States Patent [19]

Frentzel

[11] 4,187,897

[45] Feb. 12, 1980

[54] TILTING CONNECTOR FOR VENETIAN BLIND SLAT ENDS

[75] Inventor: Kurt H. Frentzel, Zevenhoven, Netherlands

[73] Assignee: Hunter Douglas International, N.V., Netherlands Antilles

[21] Appl. No.: 911,825

[22] Filed: Jun. 2, 1978

[30] Foreign Application Priority Data

Jun. 7, 1977 [DE] Fed. Rep. of Germany ..... 2725601

[51] Int. Cl.[2] ..... E06B 9/38

[52] U.S. Cl. ..... 160/177; 160/172

[58] Field of Search ..... 160/166–178

[56] References Cited

U.S. PATENT DOCUMENTS

| | | | |
|---|---|---|---|
| 2,365,004 | 12/1944 | Rice et al. | 160/177 |
| 2,874,771 | 2/1959 | Muhr | 160/176 |
| 3,651,852 | 3/1972 | Neri | 160/172 |
| 3,853,169 | 12/1974 | Music et al. | 160/172 |

*Primary Examiner*—Peter M. Caun
*Attorney, Agent, or Firm*—Pennie & Edmonds

[57] ABSTRACT

The invention relates to the guiding and tilting connector at the ends of the slats of a venetian blind which connector includes a flange secured to the end of a slat, a pivot pin extending from the flange longitudinally outwardly of the slat and a pair of guiding and tilting arms extend radially outwardly from the pivot pin. Tilt cords are secured to the outer ends of the arms. The point of connection of the tilting cords to the arms being such that in the closed position of the blind the points of connection between the arms and the tilting cords are offset horizontally with respect to a vertical plane extending through the axes of the pivot pins and also offset from the effective major vertical plane of the slats when in closed position. Because of this offset the weight of the slats in the closed position can exert a moment of force to maintain the slats tightly closed.

6 Claims, 5 Drawing Figures

TILTING CONNECTOR FOR VENETIAN BLIND SLAT ENDS

BACKGROUND OF THE INVENTION

Heretofore the guiding and tilting conectors of venetian blinds have been such that when the slats are in closed position the point of connection between the tilting cord and the tilting member is in substantial alignment vertically with the axis of the pivot pin and the plane of the slats. Under this arrangement, it is not possible for the slat to exert any moment of force by its weight tending to hold the slats closed. As a result the slats of a closed venetian blind often do not bear against each other sufficiently tightly to insure against the passage of light or tend to develop a vibrating noise that is disturbing when impinged upon by a strong draft or wind.

Furthermore, in certain previous constructions after time and with wear it was possible for the tilting cord to slip with respect to the tilting connector thus causing abrasion and wear of the cord, misorientation of the slats about their longitudinal axes, or both.

PRIOR ART

The U.S. Pat. No. 2,365,004 shows a venetian blind of the general type with which the present invention is concerned in which three modifications of guiding and tilting connectors are disclosed which connectors include a flange secured to the end of the slats, a pivot pin, and laterally extending arms to which the tilt cords are secured. In one embodiment the tilt cord is slid through a notch into an opening where it is frictionally held. In a second embodiment the tilt cord passes through a thimble squeezed in the middle to the general shape of a venturi tube being frictionally held by the narrow middle or waist portion. In the third embodiment the tilt cord is knotted about pins. Slippage can eventually develop resulting in misalignment of the slat orientation and detrimental wear to the cords.

BRIEF SUMMARY OF INVENTION

The present invention addresses the problems previously experienced by providing an arm extending radially of the pivot pin and at an angle with respect to the major plane of the slat. Adjacent the end of the arm it is secured to the tilt cord. With this construction, when the slats are in their closed position such that the lower edge of one slat slightly overlaps the upper edge of the next lower slat and bears against the face thereof, the point of connection between the tilt cord and the arm will be positioned a significant distance to one side of the vertical plane corresponding generally to the effective major plane of the slats. In this way the dead weight of the slats exerts a moment of force sufficient to insure that the slats remain well closed thus eliminating any leakage of light or any noisy vibrations.

In one embodiment of the invention the arm extends from the pivot pin in a substantially straight line to its point of connection with the tilt cord, such line being at an angle with respect to the effective major plane of the slat.

In a second embodiment of the invention a first portion of the arm is positioned at an angle with respect to the effective major plane of the slat but a second terminal portion of the arm extends from said first portion substantially parallel to the effective major plane of the slat. Another feature of the invention is that the connection between the arm and the tilt cord comprises a pin with an enlarged head over which a loop secured to the tilt cords is engaged. A snap closure is then provided that snaps into engagement with the enlarged head of the pin to insure that the loop of the tilt cord cannot become disengaged from its connection with the arm.

Still further in the preferred embodiments there are two arms extending in generally opposite directions from the pivot pin each engaged with a separate tilt cord at the end of each arm and each of said arms being symmetrical with the other.

The locking member which is snapped over the head of the connecting pin may be formed integrally with the arm initially with a reduced cross section between it and the arm. This arrangement permits the locking member to be bent into its final snapped relationship with the connector pin after the loop of the tilting cord has been engaged over the connector pin. Alternatively, this locking member may be separately formed.

BRIEF DESCRIPTION OF THE DRAWINGS

The construction of the connector of this invention and its manner of use will be apparent to those skilled in the art from the following specification and the drawings in which.

DETAILED DESCRIPTION OF THE INVENTION

Figure 1:
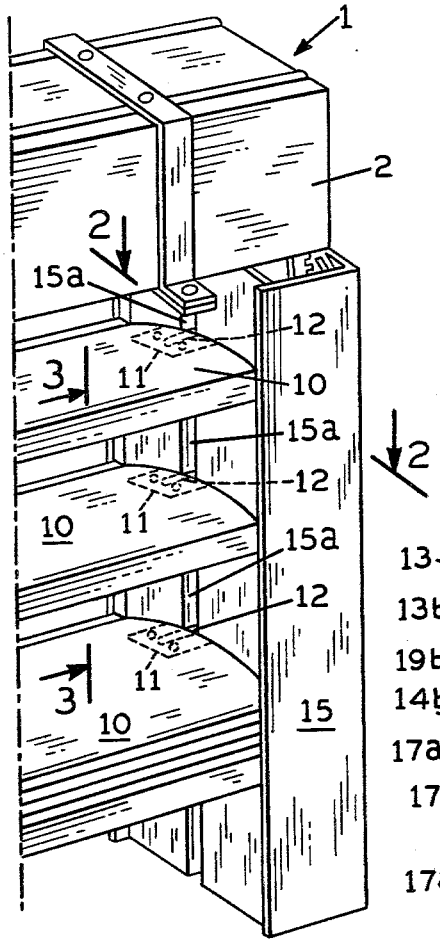
FIG. 1 is a schematic showing a portion including the right side of a venetian blind incorporating this invention.

Shown in FIG. 1 is the right-hand housing 15 and a portion of the top rail 2 of the venetian blind generally indicated at 1 of the type to which the present invention pertains. FIG. 1 is largely schematic and is shown primarily in order to better indicate the location of the other figures and the relationship of the various subassemblies to the complete blind, including the subassembly of the present invention. The venetian blind 1 includes a plurality of slats 10 which may be raised and lowered and which may be tilted about their longitudinal axes to adjust the extent to which the blind is open or closed. To this end each end of each slat 10 has a guiding and tilting connector 13 (see FIG. 2).

Figure 3:
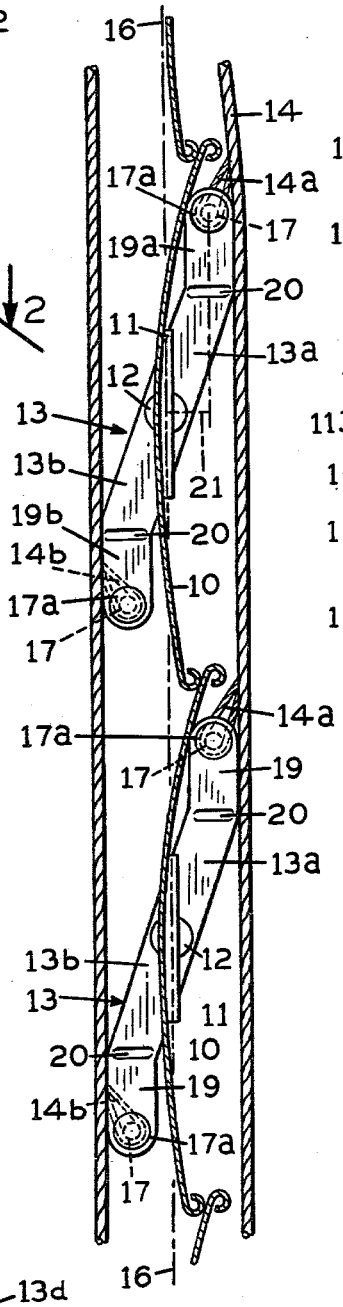
FIG. 3 is a view taken generally along the line 3—3 of FIG. 1 showing the blind in closed position and with the side housing removed for clarity.

The guiding and tilting connector 13 has a fastening flange 11 which is secured to the adjacent end of a slat 10 by any suitable means such as rivets 11A. As best shown in FIG. 3 the fastening flange 11 lies to one side of the slat 10 and is shaped to conform to the slightly curved shape of the slat. It will be appreciated that the slats 10 may in some circumstances be substantially flat in which event the fastening flange 11 would have its mating surface correspondingly shaped. Secured to and preferably integral with the flange 11 is a pivot 12 which extends through the vertical slot 15A in the housing 15. The pivot pin 12 terminates within housing 15 where it has secured to, and preferably integral therewith, a pair of arms **13*a* and 13*b* which extend radially from the pin 12. The arms 13***a* and 13*b* have terminal portions 13*c* and 13*d* respectively to which a flexible adjusting member 14 is secured in a manner described below. This flexible adjusting member 14 serves to adjust the tilt of all slats 10 and may be cable, wire, rope, cord, chain, or the like. Preferably flexible adjusting member 14 is made of light cord and as such is referred to here as the tilt cord. It will be appreciated by those skilled in the art that by referring to the same as a tilt cord applicant is not limiting himself to a particular material for this flexible member.

Figure 4:
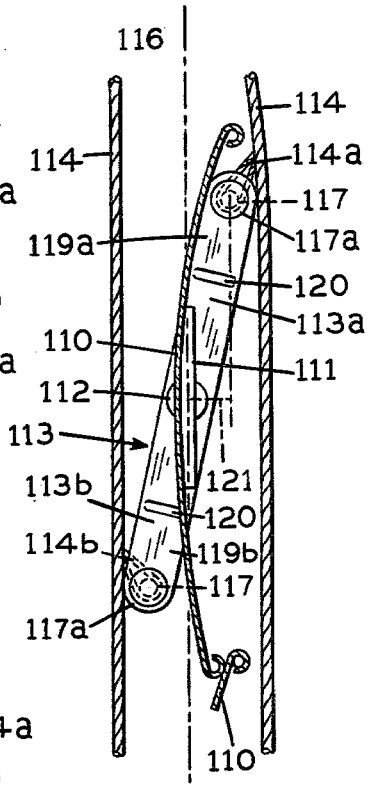
FIG. 4 is a view similar to FIG. 3 showing a modified form of guiding and tilting connector.

FIGS. 3 and 4 show two alternative embodiments for the arms with the embodiment shown in FIG. 4 being currently preferred. Description of the embodiment of FIG. 3 will, however, be first made.

As shown in FIG. 3 the arms 13*a* and 13*b* extend in generally opposite directions from the pin 12 and at an angle with respect to the major effective plane 16 of the slats 10. As used herein the term "major effective plane" refers to that plane which represents the overall course of all of the slats when the slats are closed. It is shown in dot-dash lines in FIGS. 3 and 4. The fastening flange 11 as well as the axes of the pivot pins 12 lie in this plane. The acute angle between the plane 16 and the radial direction of the arms 13*a* and 13*b* may be between 15° 30°.

The terminal portions 13*c* and 13*d* of the arms 13*a* and 13*b* respectively are arranged at an angle to their respective arms in such a manner that the portions 13*c* and 13*d* run generally parallel to each other and to the plane 16. Such is shown in FIG. 3 quite clearly with respect to the cooperating members 19*a* and 19*b* which overlie and generally correspond to the terminal portions 13*c* and 13*d* of the arms 13*a* and 13*b* respectively. It will be appreciated that in FIG. 3 the terminal portions 13*c* and 13*d* lie behind and are hidden by the portions 19.

The terminal portions 13*c* and 13*d* have extending therefrom pins 17 which extend toward the slat 10 along axes that are parallel to the axis of the pin 12. The free ends of the pins 17 have an enlarged head 17*a*. Loops 14*a* on the tilt cord 14 are adapted to be slipped over the head 17*a* and behind the same to engage the shank of the pin 17.

Figure 2:
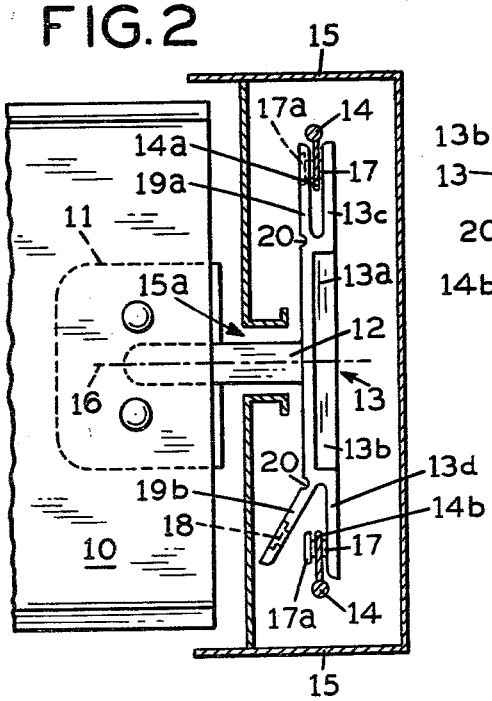
FIG. 2 is a schematic showing the connector taken generally along the line 2—2 of FIG. 1.

Locking tongues 19*a* and 19*b* are associated with terminal portions 13*c* and 13*d* respectively and are pivotally secured to the arms 13*a* and 13*b* as shown in FIG. 2. As shown, this pivoting arrangement is provided by forming the locking tongues 14*a* and 14*b* integrally with arms 13*a*, 13 *b* with a reduced cross section at 20. This arrangement provides for a pivoting hinge-like action for the locking tongues 19*a*, 19*b*. Since the entire guiding and tilting member 13 may be formed of cast or machined metal, molded plastic, or the like, the reduced portions 20 provide sufficient hinging action to permit the locking tongues to be moved from the position shown for the tongue 19*b* at the bottom of FIG. 2 into the position where they lock the loop in place against dislodgement as shown for the upper locking tongue 19*a* in FIG. 2. A recess and opening 18 in each of the members 19*a* and 19*b* is provided which corresponds to the shape of the head 17*a* and the pin 17. The head 17*a*, pin 17, and opening with recess 18 are so dimensioned for the particular material being used, preferably plastic, as to permit the head 17*a* to pass through members 19*a* and 19*b* to engage and lock the same in its closed position shown at the top for the member 19*a* in FIG. 2. Some resiliency in the material also aids this snapping action. In this position the bottom of the recess 18 lies behind the head 17*a* thus permitting the above-mentioned locking engagement. As shown, when locked in place, the outer portion of the head 17*a* is flush with the outer surface of the locking tongue 19*a* or slightly recessed, though it may protrude slightly as well. The outer circumference of the head 17*a* is tapered as shown, in order to assist in inserting the same through the smaller portion of the opening-recess 18.

It will be appreciated that after a loop 14*a* of the tilt cord 14 is placed over the head 17*a* and about the pin portion 17, and the tongues 19*a* and 19*b* are pressed onto the latter with the head 17*a* engaging the recess 18 as described there is thus formed a snap closure that reliably and securely fastens the tilt cord 14 to the pin 17 and the arms 13*a*, 13*b* of the connector and tilting member 13.

Having reference again now to FIG. 3 in which the slats 10 are shown in their closed position it will be appreciated that the pin 17 on the upper terminal portion 13*c* of the arm 13*a* forms a point of attachment to the tilt cord 14 that is offset laterally with respect to plane 16. As shown in FIG. 3 the offset is to the right for the pin 17 associated with the arm 13*a* and to the left for the pin 17 associated with arm 13*b*. In this position of the tilt cords, slats, and the overall assembly of slats in the blind, the effective connection is that at the upper arm 13*a*. It is from this arm that the weight of the slat 10 depends. The line 21 in FIG. 3 is drawn parallel to the plane 16 through the axis of the pivot pin 17 of the arm 13*a*. The distance between the plane 16 and the line 21 represents a lever arm or mechanical advantage by which the weight of the slat applied through pivot pin 12 is exerted upon the upper pin 17 and its associated tilt cord 14. By virtue of this mechanical advantage achieved through the lever arm operating through a distance between the plane 16 and the line 21 the weight of the slat multiplies its affect and tends to pivot the slat 10 counterclockwise (as viewed in FIG. 3) about the connection point of the upper pin 17 to the tilt cord 14. As a result, this arrangement serves to insure that the lower edge of the slat 10 bears firmly against the upper edge of the next lower slat 10 thus preventing any leakage of light or noisy vibrations when impinged upon by wind, breezes, or the like. Stated another way, the offset of the arms 13*a* and 13*b* laterally of the plane 16 permits the weight of the slats to exert their weight with a mechanical advantage to insure proper closure and maintenance of proper closure of the blind. It will be appreciated that if the arms 13*a* and 13*b* were not offset as shown in FIG. 3 but were arranged generally in the plane 16 which is normally the case, then, in that event there would be no multiplication of the weight and no lever arm to provide any assurance that the closed position of the slats would be maintained against light and noisy vibrations.

It will also be appreciated from FIGS. 3 and 4 that still another advantage of the angular relationship of the arms with respect to the plane of the slats and in particular with respect to the plane of the fastening flange is that this offset positioning of the pin 17 permits the ready engagement of the loop 14*a* over the pin 17 and the snap closure by means of the locking tongues 19*a* and 19*b* during assembly in the factory. In this way the slat itself does not obstruct efforts by the assembler to engage the loop 14*a* over the pin 17 as would be the case if the arms 13*a* and 13*b* extended generally in the same plane as the slat as is usually the case.

In the presently preferred embodiment shown in FIG. 4, like parts are numbered with the same numerals as FIGS. 2 and 3 excepting only that 100 has been added to the numeral. That is to say that the numeral 1 has been added preceding the like numeral. It will be immediately evident that in FIG. 4 there are no offset parallel terminal portions 13*c*, 13*d* but rather the arms 113*a* and 113*b* extend in a straight line from the pin 112 to the connecting pins 117. At the same time, however, the arms 113*a*, 113*b* are arranged at an acute angle with respect to the major effective plane 116 of the venetian blind and the slats. Line 121, corresponding to line 21 in FIG. 3, has been drawn parallel to plane 117 through the axis of pin 117. Here, again, the distance between the plane 116 and line 121 represents a lever arm which provides a mechanical advantage and multiplication of the force of the weight of the slat 110 as it is applied through the pin 117 at its connection with the tilt cord 114 tending to swing or pivot the entire connector 113 together with the slat 110 in a generally counterclockwise direction (as viewed in FIG. 4) about the upper pin 117 to insure that the lower edge bears against the upper edge of the next succeeding lower slat. all as described above with respect to FIG. 3. The attachment of the loop 114*a* of the tilt cord 114 to the pins 117 is as described above for FIGS. 2 and 3 and utilizes hinged locking tongues 119*a* and 119*b* like those shown at 19*a* and 19*b*.

Figure 5:
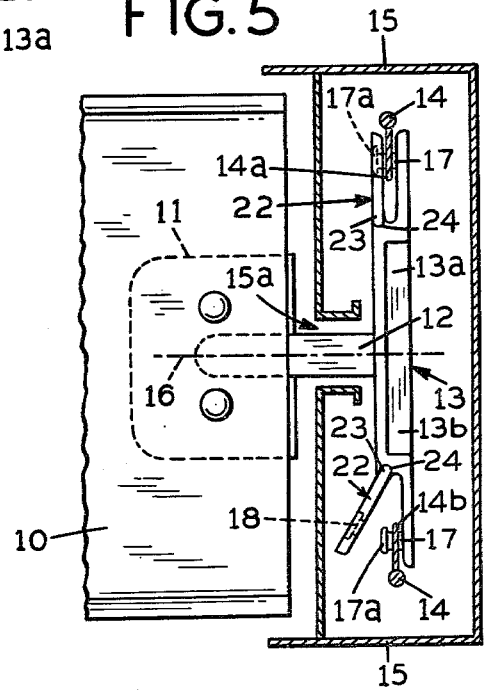
FIG. 5 is a view similar to FIG. 2 showing a modified form of locking member.

FIG. 5 discloses a modification of the hinge or pivotal arrangement by which the locking tongues are secured in place. In FIG. 5 like parts comparable to the parts of the device illustrated in FIG. 3 have like numerals. In FIG. 5 the arms 13*a*, 13*b* are provided with grooves 24. The locking tongues 22 are provided along the edge adjacent to grooves 24 with a curved reduced edge portion 23. Unlike the integral locking tongues 19*a* and 19*b* of FIGS. 2 and 3, these locking tongues 22 are separately formed from the rest of the guiding and tilting connector 13. The reduced edge portions 23 of the locking tongues 22 are so shaped and dimensioned as to fit readily within the grooves 24 and then to permit the swinging or hinging action of the locking tongues 22 toward the pin 17 and head 17*a*. Once snapped in place with the head 17*a* resting wihin the recess 18 as above described for the embodiment of FIGS. 2 and 3 the groove 24 retains the curved portion 23 therewithin and in cooperation with the pin 17 securely locks the locking tongue 22 in place which in turn secures the loop 14*a* of the tilt cord 14 on the pin 17. It will be appreciated that whether the type of locking tongue 19*a*, 19 *b* shown in FIGS. 2 and 3 or the locking tongue 22 shown in FIG. 5 is used depends upon manufacturing convenience, since in either event the blind is assembled and the locking tongue (19*a*, 19*b*, or 22) is snapped into place during assembly of the blind in the factory before shipment to a customer.

I claim:

1. In a slat guiding and tilting connector for the slats of a venetian blind having a plurality of slats each with opposite end portions connected by a connector to a flexible tilt member and in which the connector includes a fastening portion for fastening the same to the end of a slat, a pivot portion and a pair of tilting arms extending radially from the pivot portion for connection to the flexible tilt member, the improvement in which the point of connection of the tilt member to one of said arms is such that in the closed position of the slats such point of connection is offset laterally of the blind with respect to the plane containing the axes of the pivot portions of the slats whereby the weight of each slat acting through the axis of its pivot portion tends to rotate the respective slat to and maintain the slat in the closed position, said lateral offset being achieved by arms extending from said pivot portion at an acute angle with respect to said plane, each of said arms has a pin extending outwardly therefrom adjacent the terminus thereof and in which there is a locking tongue on each arm for each pin, and each of said locking tongues being pivotable with respect to its associated arm into locking engagement with its associated pin.

2. The connector of claim 1 in which said locking tongue has an opening and a recess therein, said pin has an enlarged head thereon and in which the pin, enlarged head, recess, and opening are so dimensioned as to provide mutual snapping engagement therebetween to secure the locking tongue in place.

3. The connector of claim 2 in which the axis of said pin is parallel to the axis of the pivoting portion.

4. The connector of claim 3 in which the pivoting relationship of the tongue and its associated arm is achieved by forming the same integrally with its arm and with an area of reduced cross section at the juncture between said locking tongue and said arm whereby said reduced portion serves as a hinge.

5. The connector of any one of claims 1 or 2 or 3 or 4 in which each of said arms extends in generally a straight line from the pivot portion to its point of connection with its associated tilting member.

6. The connector of any one of claims 1 or 2 or 3 or 4 in which each of said arms has a terminal portion arranged at an angle to the major portion of its associated arm and in which said terminal portions of said arms are parallel to each other and, in the closed position of the blind, generally parallel to said plane containing the axes of the pivot portions of the slats.

* * * * *